US011926964B2

(12) United States Patent
Mikkonen et al.

(10) Patent No.: US 11,926,964 B2
(45) Date of Patent: Mar. 12, 2024

(54) PRESS FELT

(71) Applicant: Valmet Technologies, Inc., Espoo (FI)

(72) Inventors: Kati Mikkonen, Tampere (FI); Satu Hagfors, Tampere (FI)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 17/951,941

(22) Filed: Sep. 23, 2022

(65) Prior Publication Data

US 2023/0094209 A1 Mar. 30, 2023

(30) Foreign Application Priority Data

Sep. 24, 2021 (FI) ..... 20215999

(51) Int. Cl.
*D21F 7/08* (2006.01)

(52) U.S. Cl.
CPC ..... *D21F 7/083* (2013.01)

(58) Field of Classification Search
CPC . D21F 7/10; D21F 7/003; D21F 7/083; D21F 1/0054; D21F 1/0036; D21F 1/0027; D21F 1/10; D21F 7/08; B01D 33/23; B01D 33/80
See application file for complete search history.

(56) References Cited

FOREIGN PATENT DOCUMENTS

DE 202021101509 U1 * 8/2021 ..... D03D 1/0094

* cited by examiner

*Primary Examiner* — Eric Hug
*Assistant Examiner* — Matthew M Eslami
(74) *Attorney, Agent, or Firm* — Stiennon & Stiennon

(57) ABSTRACT

A press felt for use in paper, cardboard or tissue machines has at least one base fabric (110), and fiber layers (120, 121) attached to the base fabric (110). The press felt fiber layers (120, 121) include thermoplastic elastomer fibers of thermoplastic elastomer originating from bio-based raw material and/or carbon-dioxide based raw material.

17 Claims, 1 Drawing Sheet

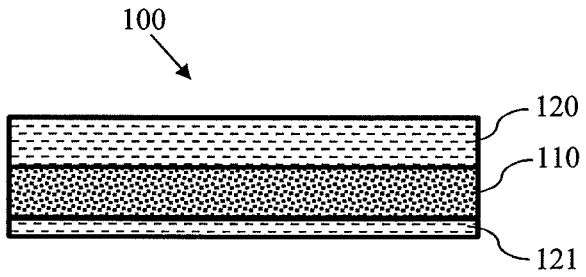
100
120
110
121

PRESS FELT

CROSS REFERENCES TO RELATED APPLICATIONS

This application claims priority on FI 20215999, filed Sep. 24, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to press felts used in paper, cardboard or tissue machines, particularly press felts comprising bio-based fibers.

A press felt plays an important role in removing the water from a paper or cardboard web after a forming section, and at the same time imparting smoothness and conveying it to a dryer section. A modern press felt comprises at least one woven or non-woven base fabric consisting of one to four layers, and a fiber layer on both sides. The press felts are usually made from polyamides (PA), for example, PA 6, PA 6.6 or PA 6.10 yarns and fibers.

When more elasticity is needed, elastic thermoplastic elastomer (TPE) fibers in the fiber layer can be utilized. The TPE fiber layer compresses in the nip and recovers quickly after improving the nip-dewatering. A resilient structure also helps to minimize vibration in the paper machine and minimize the deterioration of the fluid transport properties.

Conventionally, raw materials of the press felts have been manufactured from fossil-based raw materials and refined and processed from crude oil. Used press felts have ended up in landfill or as energy waste. In view of the increasing requirements for sustainability and emerging interest in reducing fossil-based raw materials there is a need for novel press felts that meet these expectations without sacrificing mechanical performance.

SUMMARY OF THE INVENTION

According to a first aspect of the present invention, there is provided a press felt comprising at least one base fabric, and fiber layers attached to the base fabric, which fiber layers comprise thermoplastic elastomer fibers comprising thermoplastic elastomer originating from bio-based raw material and/or carbon-dioxide based raw material.

According to an embodiment, the total amount of bio-based raw material and/or carbon-dioxide based raw material in the thermoplastic elastomer fibers is 10 to 100 wt-% calculated based on the total weight of the thermoplastic elastomer fibers.

According to an embodiment, the thermoplastic elastomer fibers comprise recycled thermoplastic elastomer.

According to an embodiment, diameters of the thermoplastic elastomer fibers are 15 to 150 μm.

According to an embodiment, thermoplastic elastomer is thermoplastic polyurethane.

According to an embodiment, the fiber layers further comprise polyamide fibers.

According to an embodiment, the polyamide fibers comprise polyamide 4.6, polyamide 4.10, polyamide 5.6, polyamide 5.10, polyamide 6, polyamide 6.6, polyamide 6.10, polyamide 6.12, polyamide 10, polyamide 11, or polyamide 12.

According to an embodiment, the fiber layers comprise the thermoplastic elastomer fibers mixed with the polyamide fibers.

According to an embodiment, the base fabric comprises one to four layers.

According to an embodiment, the base fabric (110) comprises yarns comprising polyamide.

According to an embodiment, the polyamide yarns comprise polyamide 4.6, polyamide 4.10, polyamide 5.6, polyamide 5.10, polyamide 6, polyamide 6.6, polyamide 6.10, polyamide 6.12, polyamide 10, polyamide 11, or polyamide 12.

According to an embodiment, the base fabric further comprises thermoplastic elastomer yarns comprising thermoplastic elastomer originating from bio-based raw material and/or carbon-dioxide based raw material.

According to an embodiment, the total amount of thermoplastic elastomer yarns in the base fabric is at least 10 wt-% calculated based on the total weight of the base fabric.

According to an embodiment, diameters of the thermoplastic elastomer yarns are 150 to 500 μm.

According to an embodiment, the total amount of thermoplastic elastomer originating from bio-based raw material and/or carbon-dioxide based raw material in the press felt is over 1 wt-% calculated based on the total weight of the press felt.

According to an embodiment, thermoplastic elastomer is thermoplastic polyurethane.

According to a second aspect of the present invention, there is provided a method for manufacturing a press felt, which method comprises providing at least one base fabric, providing thermoplastic elastomer fibers comprising thermoplastic elastomer manufactured from bio-based raw material and/or carbon-dioxide based raw material, and providing fiber layers on the base fabric by attaching the thermoplastic elastomer fibers on the base fabric.

According to an embodiment, providing thermoplastic elastomer fibers comprising thermoplastic elastomer manufactured from bio-based raw material and/or carbon-dioxide based raw material comprises manufacturing thermoplastic elastomer from renewable biomass sources, such as plants, trees, animals, or recycled food waste, and/or raw material manufactured by converting carbon dioxide and shaping it into the thermoplastic elastomer fibers.

According to an embodiment, thermoplastic elastomer is thermoplastic polyurethane.

According to a third aspect of the present invention, the press felt is used in a paper machine, a cardboard machine, a tissue machine or a press section of a pulp machine.

BRIEF DESCRIPTION OF THE DRAWINGS

FIG. 1 illustrates a cross section of a press felt comprising a base fabric and a fiber layer in accordance with at least some embodiments of the present invention.

DESCRIPTION OF THE PREFERRED EMBODIMENTS

In the present context, the term "bio-based raw material" refers to a raw material, which is wholly or partly derived from renewable biomass sources, such as plants, trees or animals. The raw material can be obtained from, for example, a sugar containing plant (e.g. corn or sugar cane), plant fat or oil (e.g. castor oil), organic acid (e.g. succinic acid), corn starch, straw, woodchips, sawdust, or recycled food waste. In addition, bio-based raw material can be obtained by processing directly from natural biopolymers including polysaccharides (e.g., starch, cellulose, nanocellulose, micro cellulose, chitosan and alginate) and proteins (e.g., soy protein, gluten and gelatin), or by chemically synthesizing from sugar derivatives (e.g., lactic acid) and lipids (oils and fats) from either plants or animals, or biologically generated by fermentation of sugars or lipids.

In the present context, the term "carbon-dioxide based raw material" refers to a raw material, which is manufactured by converting carbon dioxide (CO2). Carbon dioxide replaces at least partly crude oil in the carbon-dioxide based raw material. For example, carbon dioxide can be used for obtaining intermediaries for a raw material production or it can be used directly to at least partially replace ingredients derived from crude oil. Carbon dioxide can be obtained from, for example, a flue gas of a power plant or a hydrogen production.

In the present context, the term "machine-side" refers to a side of a press felt, which side is in contact with a paper, board or tissue machine equipment when the press felt is assembled to the paper, board or tissue machine.

In the present context, the term "paper-side" refers to a side of a press felt, which side faces paper, board or tissue produced when the press felt is assembled in a paper, board or tissue machine.

In the present context, the term "cross machine direction" refers to a direction which is perpendicular to the moving direction of the press felt in a paper, board or tissue machine when the press felt is assembled to the paper, board or tissue machine.

There is a need for reducing the amount of fossil-based raw materials in press felts and decreasing the carbon footprint of the press felts during the life cycle of the press felts due to increasing requirements for sustainability. The press felts should meet these expectations without sacrificing their mechanical and water removal performance. The present embodiments provide a solution to at least some of the above-mentioned problems.

FIG. 1 illustrates a cross section of a press felt 100 according to some embodiments. The press felt comprises at least one base fabric 110 and fiber layers 120, 121 attached to the base fabric 110. The base fabric 110 comprises two sides: a first side and a second side. The first side faces a machine-side of the press felt and the second side faces a paper-side of the press felt. The fiber layers 120, 121 are attached to the first side and the second side of the base fabric 110.

The fiber layers 120, 121 comprise thermoplastic elastomer (TPE) fibers comprising thermoplastic elastomer originating from bio-based raw material and/or carbon-dioxide based raw material. The present press felt provides a more sustainable option for a press felt with a low carbon footprint without sacrificing the mechanical performance of the press felt. In fact, the press felt provides at least as good mechanical properties as the conventional press felts. The press felt provides excellent machine runnability, high sheet dry content after press section, fast start-up, high web wet-strength and smooth surface properties, and a marking-free surface.

According to an embodiment, the total amount of bio-based raw material and/or carbon-dioxide based raw material in the thermoplastic elastomer fibers is 10 to 100 wt-% calculated based on the total weight of the thermoplastic elastomer fibers. Thus, the thermoplastic elastomer fibers can also comprise thermoplastic elastomer originating from crude oil based raw material or the thermoplastic elastomer fibers can comprise only bio-based raw material and/or carbon-dioxide based raw material. However, using at least partially thermoplastic elastomer originating from bio-based raw material and/or carbon dioxide based raw material enables decreasing the amount of thermoplastic elastomer originating from crude oil, which lowers the carbon footprint of the press felt.

For example, the total amount of bio-based raw material in the thermoplastic elastomer fibers can be 30 to 70 wt-%.

For example, the total amount of carbon-dioxide based raw material in the thermoplastic elastomer fibers can be 10 to 90 wt-%.

The thermoplastic elastomer fibers can comprise virgin thermoplastic elastomer. Thermoplastic elastomer originating from bio-based, carbon dioxide based, or crude oil based raw material can comprise virgin thermoplastic elastomer.

In addition or instead of the virgin thermoplastic elastomer, the thermoplastic elastomer fibers can comprise recycled thermoplastic elastomer. Thermoplastic elastomer originating from bio-based, carbon dioxide based, or crude oil based raw material can comprise recycled thermoplastic elastomer. Using recycled thermoplastic elastomer saves energy and material resources. This further reduces the carbon footprint of the press felt.

The thermoplastic elastomer fibers are staple fibers i.e., textile fibers of discrete length as opposed to filament fiber, which comes in continuous lengths.

Diameters of the thermoplastic elastomer fibers can be for example, 15 to 150 μm. Coarser thermoplastic elastomer fibers, such as fibers having diameters of 100 to 150 μm, can be mixed with finer thermoplastic elastomer fibers, such as fibers having diameters of 15 to 75 μm. By mixing fibers with different diameters, better workability of the fibers is achieved, and the properties of the press felt can be adjusted to suit the application.

For example, finer fibers having smaller diameters can be configured to a paper-side of the press felt for achieving a smooth surface, and coarser fiber having larger diameters can be configured to a wear-side or machine-side, of the press felt for achieving wear-resistance.

Preferably, the thermoplastic elastomer is thermoplastic polyurethane (TPU). Thermoplastic polyurethane provides high elasticity. A thermoplastic polyurethane fiber layer compresses in the nip and recovers quickly after improving the nip-dewatering. A resilient structure also helps to minimize vibration in the paper machine and to minimize the deterioration of fluid transport properties.

Alternatively, the thermoplastic elastomer can be a block copolymer, such as styrene-butadiene-styrene block copolymer, thermoplastic copolyester or thermoplastic polyolefin elastomer.

The fiber layers 120, 121 can also comprise fibers made of other materials than thermoplastic elastomer. For example, the fiber layers 120, 121 may further comprise polyamide fibers.

The fiber layers 120, 121 can comprise for example, 1 to 50 wt-%, preferably 30 to 50 wt-%, polyamide fibers calculated based on the total weight of the fibers in the fiber layer 120, 121.

The polyamide fibers can comprise, for example, polyamide 4.6, polyamide 4.10, polyamide 5.6, polyamide 5.10, polyamide 6, polyamide 6.6, polyamide 6.10, polyamide 6.12, polyamide 10, polyamide 11, or polyamide 12, preferably polyamide 6, polyamide 6.6, polyamide 6.10 or polyamide 11. Alternatively, the polyamide fibers can comprise copolyamides derived from more than one of the above-mentioned polyamides, or the polyamide fibers can be bicomponent fibers comprising two of the above-mentioned polyamides. The above-mentioned polyamides are excellent choices when mechanical strength and wear resistance is needed. Polyamide 6 fibers are tough, possessing high tensile strength and elasticity. They are highly resistant to abrasion and chemicals such as acids and alkalis. Polyamide 6 has high water absorption. Polyamide 66 has a high mechanical strength, rigidity and good heat and chemical stability. Polyamide 6.10 has high impact resistance, chemical resistance and retention of dimension. Polyamide 11 has lower values of density, flexural and Young's modulus, water absorption, as well as melting and glass transition temperatures lower than polyamide 6. However, polyamide 11 is seen to have increased dimensional stability in the presence of moisture than polyamide 6.

According to an embodiment, the fiber layers 120, 121 comprise the elastomer fibers mixed with the polyamide fibers. The elastomer fibers can be evenly mixed with the polyamide fibers.

According to an embodiment, the base fabric 110 comprises one to four layers. The base fabric 110 can comprise woven and/or non-woven layers. A non-woven layer can be a winded layer or a net structure layer.

According to an embodiment, the base fabric 110 comprises yarns comprising polyamide.

The polyamide yarns can comprise polyamide 4.6, polyamide 4.10, polyamide 5.6, polyamide 5.10, polyamide 6, polyamide 6.6, polyamide 6.10, polyamide 6.12, polyamide 10, polyamide 11, or polyamide 12. Alternatively, the polyamide fibers can comprise copolyimides derived from more than one of above-mentioned polyamides, or the polyamide fibers can be bicomponent fibers comprising two of the above-mentioned polyamides. Preferably, the polyamide fibers comprise polyamide 11. Polyamide 11 has good dimensional stability in the presence of moisture.

According to an embodiment, the base fabric 110 further comprises thermoplastic elastomer yarns comprising thermoplastic elastomer originating from bio-based raw material and/or carbon-dioxide based raw material. This provides a more sustainable option for the base fabric without sacrificing mechanical performance of the base fabric.

The base fabric 110 can also comprise thermoplastic elastomer fibers due to the needling of the thermoplastic elastomer fibers to the base fabric 110 during forming of the fiber layers 120, 121.

The total amount of thermoplastic elastomer yarns in the base fabric 110 can be at least 10 wt-% calculated based on the total weight of the base fabric 110. For example, every fifth yarn of the base fabric can be a thermoplastic elastomer yarn.

Preferably, at least some cross machine direction (CMD) yarns can comprise thermoplastic elastomer.

According to an embodiment, the diameters of the thermoplastic elastomer yarns are 150 to 500 μm.

Preferably, the thermoplastic elastomer is thermoplastic polyurethane in the yarns of the base fabric 110.

Alternatively, the thermoplastic elastomer can be block copolymer, such as styrene-butadiene-styrene block copolymer, thermoplastic copolyester or thermoplastic polyolefin elastomer.

According to an embodiment, the total amount of thermoplastic elastomer originating from bio-based raw material and/or carbon-dioxide based raw material in the press felt 100 is over 1 wt-% calculated based on the total weight of the press felt 100. For example, the total amount of thermoplastic elastomer originating from bio-based raw material and/or carbon-dioxide based raw material in the press felt can be 2 to 5 wt-% calculated based on the total weight of the press felt.

A method for manufacturing a press felt 100 comprises providing a base fabric 110, providing thermoplastic elastomer fibers comprising thermoplastic elastomer manufactured from bio-based raw material and/or carbon-dioxide based raw material, and providing fiber layers 120, 121 on the base fabric by attaching the thermoplastic elastomer fibers on the base fabric 110. The method provides a more sustainable way to produce a press felt, without sacrificing the mechanical properties of the manufactured press felt.

Further, the thermoplastic elastomer fibers comprising carbon-dioxide based raw material can be made using melt spinning. In melt spinning thermoplastic elastomer is melted, pressed into very fine threads, and finally processed into fibers. Unlike dry spinning used to produce conventional elastic synthetic fibers, melt spinning eliminates the need for environmentally harmful solvents.

The elastomer fibers can be attached to the base fabric by needling.

According to an embodiment, providing the thermoplastic elastomer fibers comprising thermoplastic elastomer manufactured from bio-based raw material and/or carbon-dioxide based raw material comprises manufacturing thermoplastic elastomer from renewable biomass sources, such as plants, trees or animals, or recycled food waste and/or raw material manufactured by converting carbon dioxide and shaping it into the thermoplastic elastomer fibers.

The present press felt 100 can be used in the manufacture of a fibrous web comprising cellulosic fibers. For example, the press felt 100 can be used in a paper machine, a cardboard machine, a tissue machine or a press section of a pulp machine.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "an embodiment" means that a particular feature, structure, or characteristic described in connection with the embodiment is included in at least one embodiment of the present invention. Thus, appearances of the phrase "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verb "to comprise" is used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

On earth there are two stable isotopes of carbon: $^{12}C$ making up about 99% of carbon and $^{13}C$ making up about 1% of carbon and one natural radioactive isotope $^{14}C$ with a half-life of about 5,730 years. In photosynthetic pathways $^{12}C$ is absorbed slightly more easily than $^{13}C$, which in turn is more easily absorbed than $^{14}C$, thus causing isotopic fractionation. Isotopic fractionation in plants causes proportionately greater uptake of $^{12}C$ carbon over $^{13}C$ carbon and so carbon derived from plants has less $^{13}C$ relative to $^{12}C$ than in the ratio of carbon isotopes of atmosphere air. Fossil fuels also have less $^{13}C$ relative to $^{12}C$ than the ratio of atmosphere air, and effectively no carbon 14. The carbon isotope composition of carbon sources has been well studied and analysis tools are available to determine the likely source and age of carbon in a particular sample. In view of the differences between the isotope ratios in carbon from fossil fuels and the carbon isotope ratios in the carbon dioxide of the atmosphere, the sources of the carbon in the carbon compounds making up press felts can be reasonably well determined. For example, carbon from fossil fuels has no carbon-14, and is depleted in carbon-13 relative to the atmosphere. Carbon from non-fossil, bio-based raw materials will have carbon-14 content at or near that of the atmospheric carbon dioxide and be depleted in carbon-13 relative to the atmosphere. Carbon recovered from atmospheric carbon dioxide will have carbon-14 content at or near that of the atmosphere and a carbon-13 to carbon-12 ratio at or near that of the atmosphere. Carbon dioxide recovered from combusting fossil fuels with air will have a small fraction of the carbon-14 of atmospheric carbon dioxide, because the carbon dioxide in the combustion air with the atmosphere concentration of $^{14}C$ is diluted by the carbon dioxide formed from the fossil fuel and the oxygen in the combustion air. The ratio is calculated from the known concentration of carbon dioxide in the air of about 400 parts per million or 0.0004. The atmospheric air of 21% oxygen is combusted with carbon to form a molar of concentration of 21% carbon dioxide. Carbon dioxide in air is about 400 parts per million divided by 21% is 0.0004/0.21=0.0019 so the level of carbon-14 is 0.19% or 1/525 of the concentration of carbon-14 in the atmosphere.

We claim:

1. A press felt in a paper machine, a cardboard machine, a tissue machine or a press section of a pulp machine, the press felt comprising:

at least one base fabric comprising yarns comprising polyamide, and thermoplastic elastomer yarns comprising thermoplastic elastomer originating from at least one of bio-based raw material and carbon-dioxide based raw material, wherein the total amount of thermoplastic elastomer yarns in the at least one base fabric is at least 10 wt-% calculated based on the total weight of the at least one base fabric;

fiber layers attached to the base fabric, which fiber layers comprise thermoplastic elastomer fibers comprising thermoplastic elastomer originating from at least one of bio-based raw material and carbon-dioxide based raw material;

wherein the thermoplastic elastomer is thermoplastic polyurethane in the fiber layers, and the fiber layers further comprise 1 to 50 wt-% polyamide fibers calculated based on the total weight of the fibers in the fiber layers; and wherein the total amount of bio-based raw material in the thermoplastic elastomer fibers is 30 to 70 wt-%.

2. The press felt of claim 1 wherein the total amount of at least one of bio-based raw material and carbon-dioxide based raw material, in the thermoplastic elastomer fibers is 10 to 100 wt-% calculated based on the total weight of the thermoplastic elastomer fibers.

3. The press felt of claim 1 wherein the thermoplastic elastomer fibers comprise recycled thermoplastic elastomer.

4. The press felt of claim 1 wherein the thermoplastic elastomer fibers have a diameter of 15 to 150 μm.

5. The press felt of claim 1 wherein the thermoplastic elastomer is thermoplastic polyurethane in the yarns of the at least one base fabric.

6. The press felt of claim 1 wherein the polyamide fibers are selected from the group consisting of: polyamide 4.6 fibers, polyamide 4.10 fibers, polyamide 5.6 fibers, polyamide 5.10 fibers, polyamide 6 fibers, polyamide 6.6 fibers, polyamide 6.10 fibers, polyamide 6.12 fibers, polyamide 10 fibers, polyamide 11 fibers, and polyamide 12 fibers.

7. The press felt of claim 6 wherein the fiber layers comprise the thermoplastic elastomer fibers mixed with the polyamide fibers.

8. The press felt of claim 1 wherein the at least one base fabric comprises 1 to 4 layers.

9. The press felt of claim 1 wherein the polyamide yarns are selected from the group consisting of: polyamide 4.6 yarns, polyamide 4.10 yarns, polyamide 5.6 yarns, polyamide 5.10 yarns, polyamide 6 yarns, polyamide 6.6 yarns, polyamide 6.10 yarns, polyamide 6.12 yarns, polyamide 10 yarns, polyamide 11 yarns, and polyamide 12 yarns.

10. The press felt of claim 1 wherein the thermoplastic elastomer yarns have a diameter of 150 to 500 μm.

11. The press felt of claim 1 wherein the total amount of thermoplastic elastomer originating from at least one of bio-based raw material and carbon-dioxide based raw material in the press felt is over 1 wt-% calculated based on the total weight of the press felt.

12. The press felt of claim 1 wherein the base layer has a machine-side facing side and an opposed paper side facing side, and wherein the fiber layers comprise a first fiber layer attached to the machine-side facing side of the base layer and a second fiber layer attached to the paper side facing side of the base layer.

13. A method for manufacturing a press felt, which method comprises the steps of: providing at least one base fabric comprising yarns comprising polyamide and thermoplastic elastomer yarns comprising thermoplastic elastomer originating from bio-based raw material and/or carbon-dioxide based raw material, wherein the total amount of thermoplastic elastomer yarns in the at least one base fabric is at least 10 wt-% calculated based on the total weight of the at least one base fabric; providing thermoplastic elastomer fibers comprising thermoplastic elastomer manufactured from bio-based raw material and/or carbon-dioxide based raw material; and providing fiber layers on the base fabric by attaching the thermoplastic elastomer fibers on the base fabric wherein the thermoplastic elastomer fibers are manufactured of at least one of bio-based raw material and carbon-dioxide based raw material, wherein the thermoplastic elastomer is thermoplastic polyurethane in the fiber layers, and the fiber layers further comprise 1 to 50 wt-% polyamide fibers calculated based on the total weight of the fibers in the fiber layers; and wherein the total amount of bio-based raw material in the thermoplastic elastomer fibers is 30 to 70 wt-%.

14. The method of claim 13 wherein the thermoplastic elastomer fibers are made from at least one of a renewable biomass and converted carbon dioxide, shaped into the thermoplastic elastomer fibers.

15. The method of claim 14 wherein the renewable biomass shaped into the thermoplastic elastomer fibers is selected from the group consisting of: plants, trees, animals, and recycled food waste.

16. The method of claim 13 wherein the thermoplastic elastomer is thermoplastic polyurethane in the yarns of the at least one base fabric.

17. A method comprising using a press felt of claim 1 in a paper machine, a cardboard machine, a tissue machine or a press section of a pulp machine, the method comprising the steps of:

manufacturing the press felt from a least one base fabric.

* * * * *